US006252169B1

(12) United States Patent
Gegusch-Brunner et al.

(10) Patent No.: US 6,252,169 B1
(45) **Date of Patent: *Jun. 26, 2001**

(54) ELECTRICALLY CONDUCTING CABLE CONTAINING A SINGLE CONDUCTOR CONSISTING OF ADJOINING REGIONS HAVING SUCCESSIVELY SMALLER CROSS-SECTIONS

(75) Inventors: Hans Gegusch-Brunner, Ettlingen; Bernd Aupperle, Steinheim; Joachim Schenk, Hemmingen, all of (DE)

(73) Assignee: Robert Bosch GmbH, Stuttgart (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/297,849

(22) PCT Filed: Aug. 27, 1998

(86) PCT No.: PCT/DE98/02520

§ 371 Date: May 6, 1999

§ 102(e) Date: May 6, 1999

(87) PCT Pub. No.: WO99/16085

PCT Pub. Date: Apr. 1, 1999

(30) Foreign Application Priority Data

Sep. 24, 1997 (DE) ..... 197 42 092

(51) Int. Cl.[7] ..... H01B 7/00

(52) U.S. Cl. ..... 174/71 R; 174/117 F

(58) Field of Search ..... 174/117 F, 72 R, 174/71 R, 72 A; 307/10.1, 10.7, 38, 31, 29; 439/52

(56) References Cited

U.S. PATENT DOCUMENTS

| | | | | |
|---|---|---|---|---|
| 3,836,415 | * | 9/1974 | Hilderbrandt | 174/72 A X |
| 5,604,331 | * | 2/1997 | Matarin et al. | 174/121 A |
| 5,936,317 | * | 8/1999 | Sasanouchi et al. | 307/10.7 |
| 5,997,338 | * | 12/1999 | Pohjola | 439/425 |

FOREIGN PATENT DOCUMENTS

2275373 * 8/1994 (GB) .

* cited by examiner

*Primary Examiner*—Dean A. Reichard
*Assistant Examiner*—Chau N. Nguyen
(74) *Attorney, Agent, or Firm*—Michael J. Striker

(57) ABSTRACT

The electrically conducting cable for making an electrical connection between consumers and a voltage supply device (13) has a single conductor made of electrically conductive material and a common plug (11) at one end of the single conductor for connection to a common voltage supply device (13). The single conductor is subdivided into respective regions (A,B,C) of different cross-sections, which become progressively smaller in a direction along the single conductor from the plug (11) toward the consumers (1,2,3, 4,5,6,7,8). Each region is connected to at least one consumer at a branch point at the end of the region, advantageously via an overload-protected semiconductor switch, so that all the consumers are supplied via the single conductor.

5 Claims, 1 Drawing Sheet

ELECTRICALLY CONDUCTING CABLE CONTAINING A SINGLE CONDUCTOR CONSISTING OF ADJOINING REGIONS HAVING SUCCESSIVELY SMALLER CROSS-SECTIONS

BACKGROUND OF THE INVENTION

1. Field of the Invention

The invention relates to an electrically conducting cable for connecting consumers and a voltage supply device, especially in conjunction with a vehicle electric system.

2. Prior Art

The connection of consumers in a voltage supply system, for instance in a vehicle electric system with the voltage supply, such as the battery or a plug which in turn is connected to the battery, is typically done today via cable harnesses. Such cable harnesses include many electric lines which are parallel to one another and are connected jointly to the plug or the battery or a generator; on the other side of the line, a single load or a single electrical consumer is connected. The cable harnesses typically include lines of variable cross section, and the cross section is adapted in each case to the power consumption of the consumer, so that high current consumers are supplied via lines of large cross section, while consumers that take up less power are supplied via thinner cables. During the typical operation of the voltage supply system, such as the vehicle electric system, only a small proportion of the consumers are turned on, so that most of lines carry no current at all at that time. These currentless cables are to be avoided by using the electrically conducting cable of the invention.

SUMMARY

It is an object of the present invention to provide an electrically conducting cable in which the above-described disadvantages are eliminated or greatly reduced.

It is an additional object of the present invention to provide an electrically conducting cable for supplying a plurality of consumers, especially in a motor vehicle, which is more economical to make requiring less material, which is more flexible so that it is easier to install and which consumes less power.

According to the invention, the electrically conducting cable for making an electrical connection between consumers and a voltage supply device has a single conductor made of electrically conductive material and a common plug connected at one end of the single conductor. The single conductor is subdivided into respective regions having cross sections that become progressively smaller in a direction along the single conductor from the plug toward the consumers. Each region is connected to at least one consumer, so that all consumers are electrically connected to the voltage supply device through the single conductor which is the sole means of making electrical connection of the consumers to the voltage supply device when the plug is connected with the voltage supply device.

The electrically conducting cable of the invention has the advantage that maximum utilization of the cable is possible, since only minimal line segments are currentless. It is also advantageous that a reduction in power losses is attainable, since the maximal cable cross section is also available for small currents. Another advantage is that no insulation of individual strands of the cable harness is needed, so that an economy of material, such as copper, is possible, since the design of the cross section can be optimized and is thus smaller overall than with individual cables. Because of the small cross section, more-flexible installation is possible, and economy in terms of contacts is advantageously possible, for instance in protecting against short circuits.

With the economy in terms of insulation for individual cables and the economy of material, a reduction in weight can advantageously be attained.

These advantages are attained in that the embodiment of the cable is such that the largest cable cross section occurs on the connection side that is connected to the voltage supply, or to a plug that leads to the voltage supply. This cable cross section extends over a first region, at whose end the first instances of branching occur. In the next segment, the cable has a lesser cross section, and in the segment that follows that, after further instances of branching, the cross section of the cable is further reduced. Overload-protected switch means, such as semiconductors, which switch and/or control the loads located at the end of the branching individual strands, are located at each of the branching points. These semiconductors are advantageously designed as high-side switches, which makes direct mounting of the semiconductors onto the conductor material, for instance copper, possible so that this material can additionally be used as a heat sink.

Further advantages of the invention reside in high flexibility with the simultaneous use of a data bus. Individual expandability of the cable is conceivable. Diagnosis of the cable harness can be done in an advantageous way. Because of the semiconductor-switched cable branches, fuses can be omitted, if they are replaced with smart end stages. The possibility exists of turning off some branches, for instance upon a generator overload or the like. Thus a portion of the on-board electrical system can be decoupled directly, should problems with the energy supply require this. Another advantage of the invention is due to the cable branch protection by means of a minimal cross section and the general capability of dispensing with fuses.

Various configurations of cable harnesses, cable regions, cable trunks, cable branches and individual strands are advantageously possible.

BRIEF DESCRIPTION OF THE DRAWING

The objects, features and advantages of the invention will now be illustrated in more detail with the aid of the following description of the preferred embodiments, with reference to the accompanying figures in which.

DESCRIPTION OF THE PREFERRED EMBODIMENTS

Figure 1:
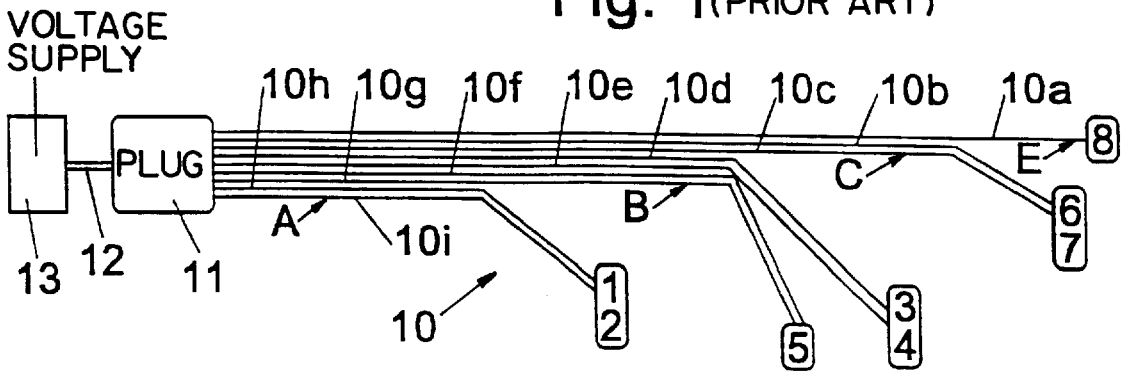
Fig. 1 (PRIOR ART)
FIG. 1 is diagrammatic view of a cable harness of the prior art.

In FIG. 1, a conventional cable harness 10 is shown, which comprises four regions A, B, C, E and is connected to a collective plug 11, which is connected via a connection 12 to a voltage supply unit 13, such as a motor vehicle battery or a generator.

In the example of FIG. 1, the cable harness 10 comprises nine individual lines 10*a, b, . . . , i*, which optionally have different cross sections. These lines or individual strands are extended parallel and lead to centrally controlled loads 1–8. Of the loads, some are combined in pairs, namely loads 1 and 2, loads 3 and 4, and loads 6 and 7. Load 8 is a single load, and load 5 has a redundant supply via two separate individual strands. The load 5 may be an electrical consumer whose functional course is especially safety-relevant, such as an electric brake or a control unit for anti-lock braking.

Figure 2:
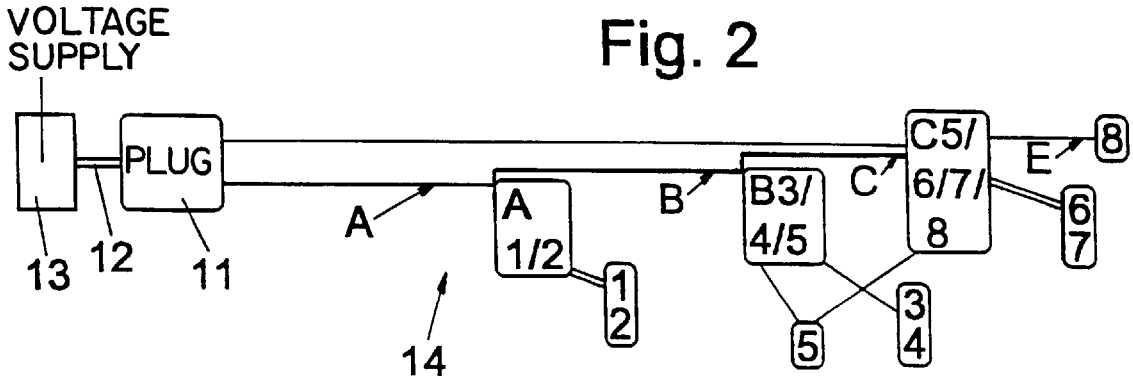
FIG. 2 is a diagrammatic view of a first embodiment of a cable harness according to the invention.

In FIG. 2, a first exemplary embodiment of the invention is shown, and this exemplary embodiment has the same consumers 1–8. Once again, the cable harness is connected to a collective plug 11, which via a connection 12 is connected to the voltage supply device 13, or is connected directly to the battery, the generator, or a distributor. The cable harness 14 here comprises a cable trunk, in which the individual strand cross sections are combined in the regions A, B and C. The cross section of the cable harness is greatest in region A, next greatest in the region B, and third-greatest in region C. In region E, as in the example of FIG. 1, only an individual strand is present.

Overload-protected end stages A 1/2, B 3/4/5 and C/5/6/7/8 are built in between the cable harness and the loads or consumers 1–8. These overload-protected end stages are triggered externally, for instance by a central control unit. They switch the loads assigned to them to the applicable region of the cable harness. The overload-protected end stages furthermore assure that no short circuits or the like will occur.

In the exemplary embodiment of FIG. 2, the load 5 is supplied redundantly via different cable harness branches B and C and the associated overload-protected end stages. As a result of this redundant supply via different cable harness branches, an especially safe and reliable voltage supply is assured even if malfunctions occur.

Figure 3:
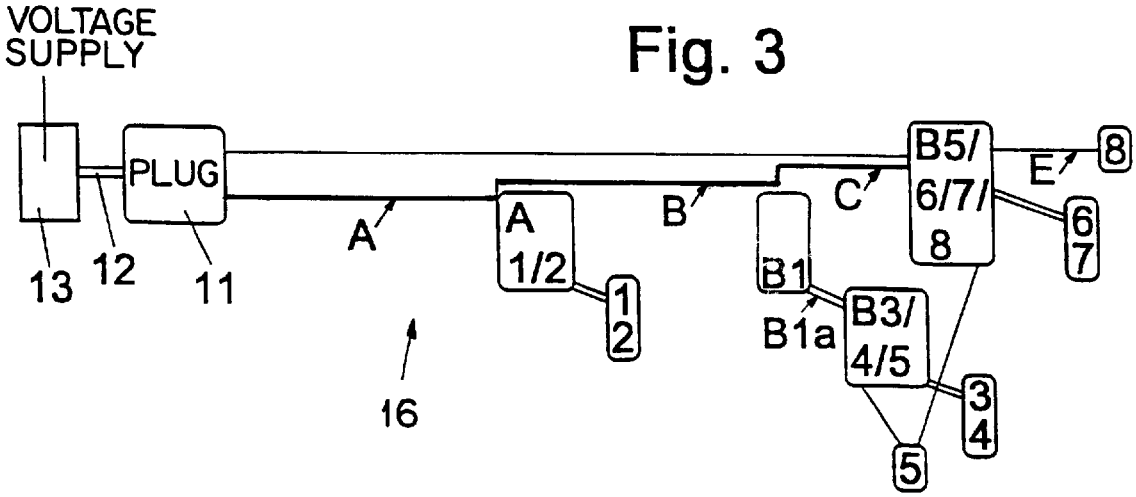
FIG. 3 is a diagrammatic view of a second embodiment of a cable harness according to the invention.

In FIG. 3, a second exemplary embodiment of the invention is shown, with a cable harness 16 that up to region B corresponds to the exemplary embodiment of FIG. 2. At the end of the cable harness branch or region B, here there is an overload-protected end stage B1, which communicates via a further cable harness branch or region B1*a* with the end stage B3/4/5. The cable harness branch B also leads via the cable harness branch C of thinner cross section to the overload-protected switches B5/6/7/8. Connected to these overload-protected switches are not only the loads 6 and 7 but also the load A via the individual strand E, as well as the load 5, which also communicates with the overload-protected switches B1 via the overload-protected switches B3/4/5 and the cable harness branch B1*a*. The consumers 3 and 4 are also supplied via the overload-protected switches B3/4/5.

The adaptation of the cross sections of the cable harness trunk A and the cable harness branches B1 and C can in turn be defined on the basis of the expected consumption capacities of the electrical consumers. With the cable harness with a cable trunk and cable branches shown in FIG. 3, the possible potential economy for the conductor material is fully exploited.

An especially economical way of constructing the cable harness can be attained by arranging the overload-protected semiconductor switches in control elements of components of the consumers as indicated by the dashed line in FIG. 3, and by embodying the strand or cable branch directly as a fuse over a short segment where the individual strands branch off. If a short circuit occurs, the individual strands would have to be hammered to the cable trunk or the cable branch via a protection element. Thus fuses and contacts currently needed in cable harnesses in the motor vehicle, in which each consumer is protected individually, and in which many of these fuses in typical operation never become active, can be dispensed with.

What is claimed is:

1. An electrically conducting cable for electrically connecting a plurality of consumers with a voltage supply device (13), wherein said electrically conducting cable consists of a single conductor, a plug (11) for electrical connection of the single conductor with the voltage supply device (13) and a plurality of overload-protected externally triggered semiconductor switches (A1/2; B3/4/5; C5/6/7/8) for electrically connecting or disconnecting said consumers with said single conductor;

wherein said plug is electrically connected to the single conductor at one end of the single conductor and each of said overload-protected externally triggered semiconductor switches is electrically connected to said single conductor;

wherein said single conductor consists of a plurality of adjoining regions of an electrically conductive material and said adjoining regions have cross-sections that are successively smaller in a direction along the single conductor from the plug toward the consumers;

wherein each of said adjoining regions is electrically connected to a different one of said overload-protected externally triggered semiconductor switches at a branch point at an end of said adjoining region to which said different one of said overload-protected externally triggered semiconductor switches is connected;

so that said consumers are electrically connected to or disconnected from said single conductor via said overload-protected externally triggered semiconductor switches when said semiconductor switches are externally triggered.

2. The electrically conducting cable as defined in claim 1, wherein said respective overload-protected externally triggered semiconductor switches are disposed directly on the electrically conductive material of the single conductor.

3. The electrically conducting cable as defined in claim 1, wherein said adjoining regions consist of a cable trunk (A) and cable branches (B,C), said cable trunk (A) consists of the one of said adjoining regions that is closest to the plug and said cable branches (B,C) consist of a remaining part of the adjoining regions not including said cable trunk (A).

4. The electrically conducting cable as defined in claim 3, wherein each of said cable branches (B,C) is electrically connected with a different one of said consumers (1,2,3,4, 6,7,8).

5. The electrically conducting cable as defined in claim 3, wherein at least two of said cable branches (B,C) are electrically connected to a single safety relevant one (5) of said consumers to provide a redundant supply for said single safety relevant one of said consumers.

* * * * *